US005323918A

United States Patent [19]

Fair

[11] Patent Number: 5,323,918

[45] Date of Patent: Jun. 28, 1994

[54] ADHESIVE SHEET SEPARATOR

[75] Inventor: James C. Fair, Red Wing, Minn.

[73] Assignee: Moore Business Forms, Inc., Grand Island, N.Y.

[21] Appl. No.: 63,698

[22] Filed: May 20, 1993

[51] Int. Cl.[5] ..... B65H 3/00

[52] U.S. Cl. ..... 221/36; 221/33; 221/42; 271/21; 271/22; 156/572; 156/584

[58] Field of Search ..... 221/33, 36, 40, 41, 221/42, 43, 259, 231, 232, 277; 271/19, 21, 22, 24, 25, 42, 128, 105, 106, 161; 156/344, 570, 572, 584

[56] References Cited

U.S. PATENT DOCUMENTS

| | | | |
|---|---|---|---|
| 616,043 | 0/1898 | Willetts . | |
| 1,003,558 | 9/1911 | Welsh | 271/24 |
| 2,986,391 | 5/1961 | Walker | 270/58 |
| 3,095,193 | 6/1963 | Sorenson | 271/42 |
| 3,190,642 | 6/1965 | Smith | 271/42 |
| 3,269,591 | 8/1966 | Harter | 221/23 |
| 3,630,515 | 12/1971 | Knapp | 271/4 |
| 3,785,637 | 1/1974 | Van Der Does | 271/24 |
| 3,960,291 | 6/1976 | Navi | 221/36 |
| 4,428,793 | 1/1984 | Sato et al. | 156/572 X |
| 4,463,943 | 8/1984 | Deconinck | 271/21 |
| 4,651,982 | 3/1987 | Martin | 271/4 |
| 5,029,838 | 7/1991 | Kunihiro | 271/119 |
| 5,112,427 | 5/1992 | Bekker-Madsen | 156/259 |

FOREIGN PATENT DOCUMENTS

| | | | |
|---|---|---|---|
| 481409 | 8/1929 | Fed. Rep. of Germany | 271/19 X |
| 1341133 | 9/1987 | U.S.S.R. | 271/22 X |

*Primary Examiner*—D. Glenn Dayoan
*Assistant Examiner*—Dean A. Reichard
*Attorney, Agent, or Firm*—Nixon & Vanderhye

[57] ABSTRACT

A sheet separating device for removing an uppermost sheet of an adhesive pad containing a plurality of such sheets includes a housing; a support plate for holding the pad, resiliently biased in an upward direction. A sheet separator mechanism is movable in forward and reward directions, includes a frame, a pick wheel mounted for rotation within the frame, and a knife blade having a closed periphery opening therein defined in part by at least one entry projection, wherein the pick wheel is located ahead of the at least one entry projection of the knife blade in the forward direction such that, in use, the pick wheel lifts an edge of the uppermost sheet extending transverse to the forward direction, and the at least one entry projection of the knife blade then moves between the uppermost sheet and a next underlying sheet as the uppermost sheet passes through the closed periphery opening.

15 Claims, 6 Drawing Sheets

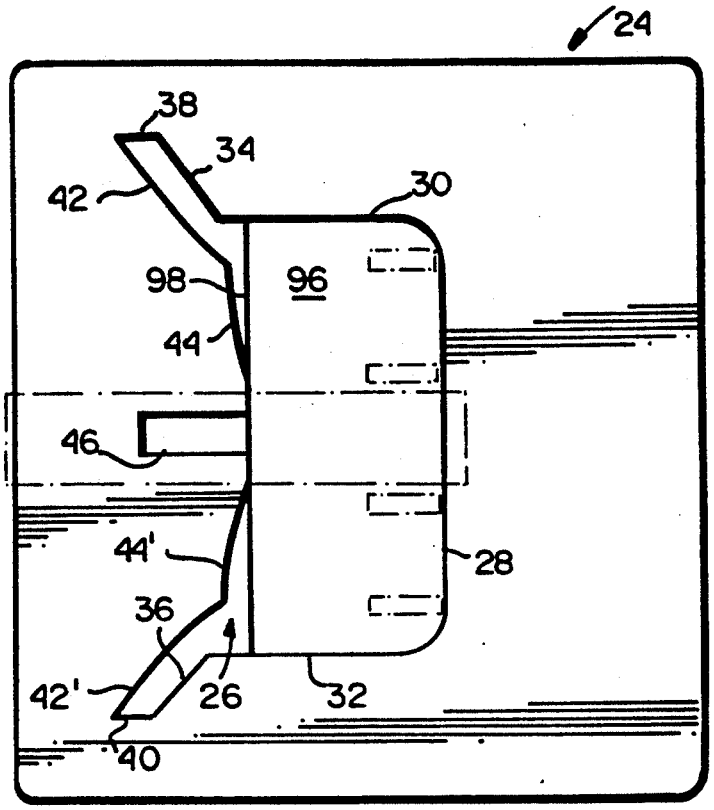
Fig. 5
Fig. 6
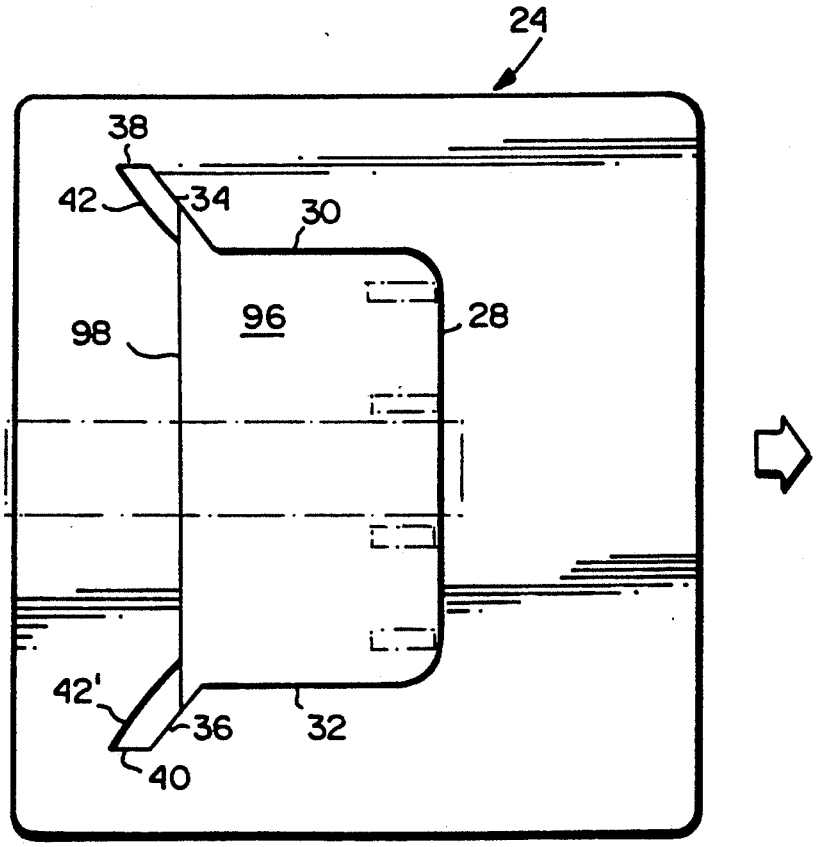

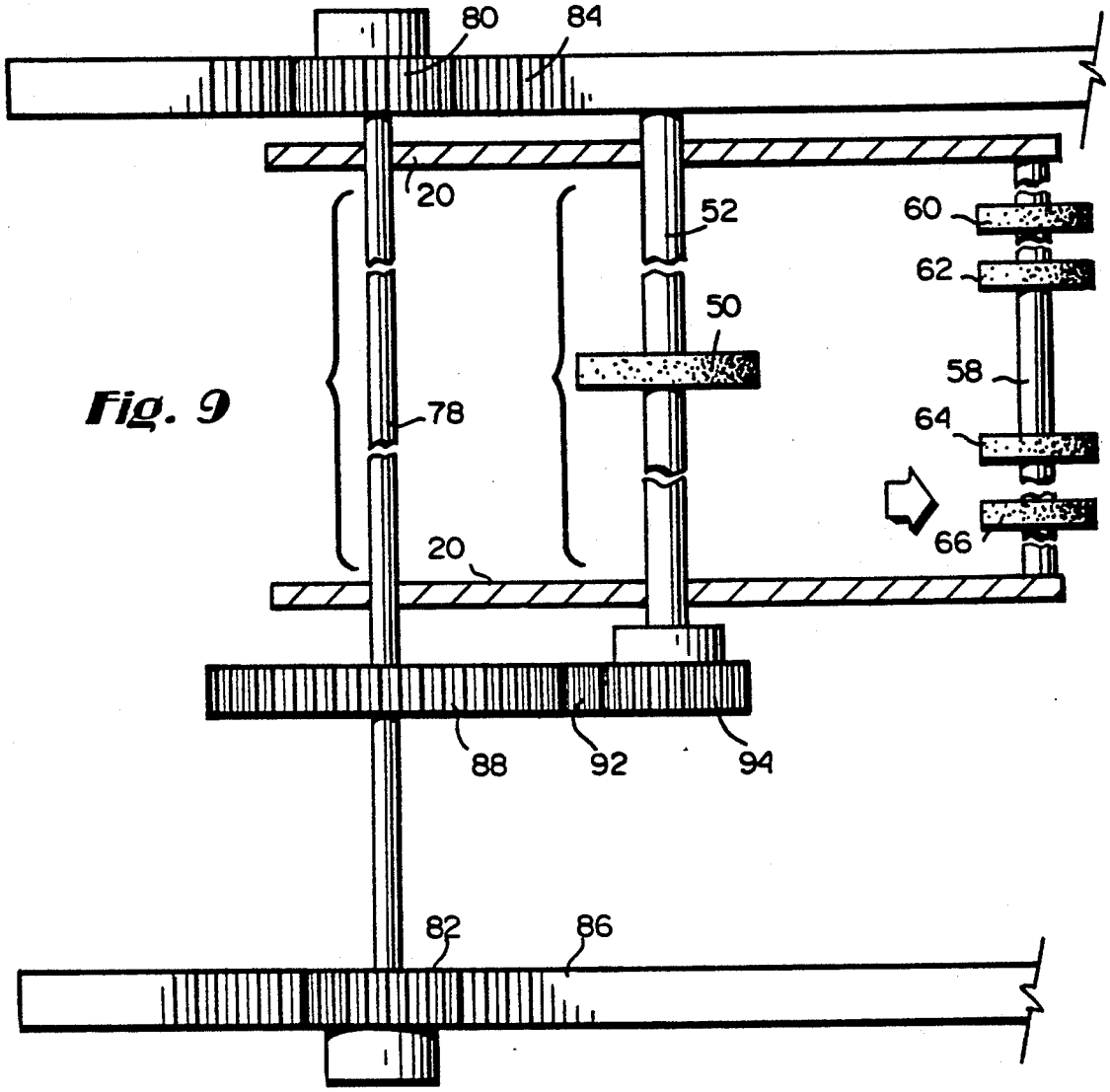
Fig. 9
Fig. 10
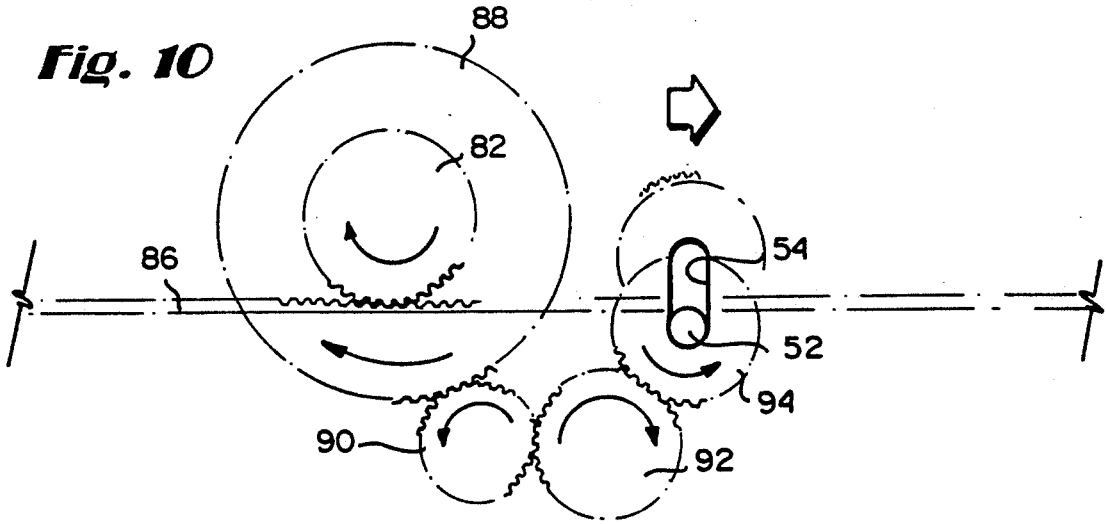

ADHESIVE SHEET SEPARATOR

This invention relates to a device for quickly and reliably separating an uppermost sheet of a stack of sheets in a pad, wherein each sheet in the stack is secured to the next underlying sheet by a pair of low tack, repositionable adhesive strips.

BACKGROUND AND SUMMARY OF THE INVENTION

Note pads comprising a stack of sheets adhesively secured along one edge are by now well known, and include the Note Stix® brand pads manufactured and sold by the assignee of this invention. The self-stick adhesive strips applied to the underside of the sheets in such pads permits one sheet to be peeled from the next, and the separated sheet may then be re-adhered to another surface. This adhesive is also well known, and is often referred to as "low tack" or "repositionable" adhesive. As will be appreciated, the advent of such note pads has given rise to a variety of pad constructions for use in many fields. One relatively new application relates to a label pad in which individual label sheets are provided with low tack or repositionable adhesive along two opposite edges of each label sheet within the pad. This type of pad is used, for example, by product manufacturers who remove the labels, one at a time, from the pad and then adhere them to finished products (for example, prefabricated window assemblies) prior to shipment. A problem exists in that it is often difficult to locate an edge (or portion of an edge) of the label sheet which will most easily permit removal of the sheet from the pad. If, for example, one were to attempt to peel the label from the pad along one of the two edges extending perpendicular to the opposite adhesive edges, the label sheet will often tear. Moreover, upon peeling the label sheet from the pad, edge curling often occurs. Because of the low tack nature of the adhesive, the one or more curled edges tend to override the sticking power of the adhesive so that the label edges curl away from the product to which the label is ultimately adhered. In a case of severe curling, the label sheet may completely separate from the product.

It is the principal object of this invention to provide a simple mechanical device which will quickly and reliably separate an uppermost label sheet from a pad of such sheets, without tearing and without incurring curled edges. In other words, the label sheet as separated from the stack in accordance with this invention remains in a substantially flat condition so that it may be reliably adhered to a product or other "end use" surface.

In an exemplary embodiment, the device of this invention includes a housing supporting a pad of label sheets, urging the pad or stack upwardly to a reference position where the uppermost label sheet may be removed as described herein. The housing mounts a sheet separator mechanism for manually driven reciprocating movement in opposite horizontal directions relative to the housing and to the stack.

The sheet separator includes geared drive wheels movable along laterally spaced gear tracks which confine the sheet separator to straight-line (or axial) reciprocating movements, i.e., in a forward direction to separate the uppermost sheet and in a rearward direction to re-set the separator mechanism. In the exemplary embodiment, the pad is oriented so that adhesive edges of the label sheets lie along the gear tracks, i.e., parallel to the direction of movement of the sheet separator. The separator mechanism includes a substantially planar blade member which acts in concert with a "pick wheel" which, in turn, is arranged to initially lift the uppermost label sheet slightly, at an intermediate, localized area along a transverse edge of the label sheet. Immediately upon lifting of the localized edge portion, and as the separator mechanism continues to be driven in the separating direction, the separator blade will move through the pad, beneath the uppermost sheet. As the blade progresses through the pad, the uppermost sheet is progressively separated along the two opposite adhesive edges. Upon completion of the forward stroke of the separator mechanism, the uppermost label sheet is simply lifted off the separator mechanism in a flat condition, and is re-adhered to another surface as desired. The separator mechanism is then returned and re-set for separation of the next uppermost label sheet.

The pick wheel is caused to rotate by means of a gear train connected to the geared drive wheels. The gear connection is such that the pick wheel rotates in a direction opposite to that of the drive wheels. Both the pick wheel and the blade are secured to the sheet separator mechanism in substantially fixed axial relationship to each other.

Thus, in accordance with its broader aspects, the invention provides for use with a pad of sheets where each sheet is adhered to an underlying sheet by a pair of laterally spaced, substantially parallel strips of light tack adhesive located along opposite side edges of the sheet, a device for separating an uppermost sheet of the pad comprising lifting means for lifting an edge of the uppermost sheet intermediate the parallel strips of light tack adhesive; blade means for insertion between the uppermost sheet and an underlying sheet at a location where the transverse edge has been lifted by the lifting means; and drive means for moving the blade means in a first direction parallel to the strips of light tack adhesive through the pad to thereby separate the uppermost sheet from the underlying sheet.

In another aspect, the invention relates to a sheet separating device for removing an uppermost sheet of an adhesive pad containing a plurality of such sheets, the device comprising a housing; a support plate for holding said pad, said support plate being resiliently biased in an upward direction; a sheet separator mechanism movable in forward and rearward directions, the sheet separator mechanism including a frame, a pick wheel mounted for rotation within the frame, and a knife blade having a closed periphery opening therein defined in part by at least one entry projection, wherein the pick wheel is located ahead of the at least one entry projection of the knife blade in the forward direction such that, in use, the pick wheel lifts an edge of the upper most sheet extending transverse to the forward direction, and the at least one entry projection of the knife blade then moves between the uppermost sheet and a next underlying sheet.

It will be appreciated that the apparatus described herein is highly advantageous in any circumstance where it is desired to successively remove sheets from an adhesive pad without tearing the sheet and/or curling the edges of the separated sheet. Other objects and advantages will become apparent from the detailed description which follows.

BRIEF DESCRIPTION OF THE DRAWINGS

FIGS. 5 through 8 are partial plan views, illustrating the separator blade at successive stages of travel through the stack;

FIG. 9 is a partial plan view illustrating the drive wheels of the sheet separating mechanism and the geared connection to the pick wheel; and FIG. 10 is a partial side view of the drive mechanism shown in FIG. 9.

DETAILED DESCRIPTION OF THE DRAWINGS

Figure 1:
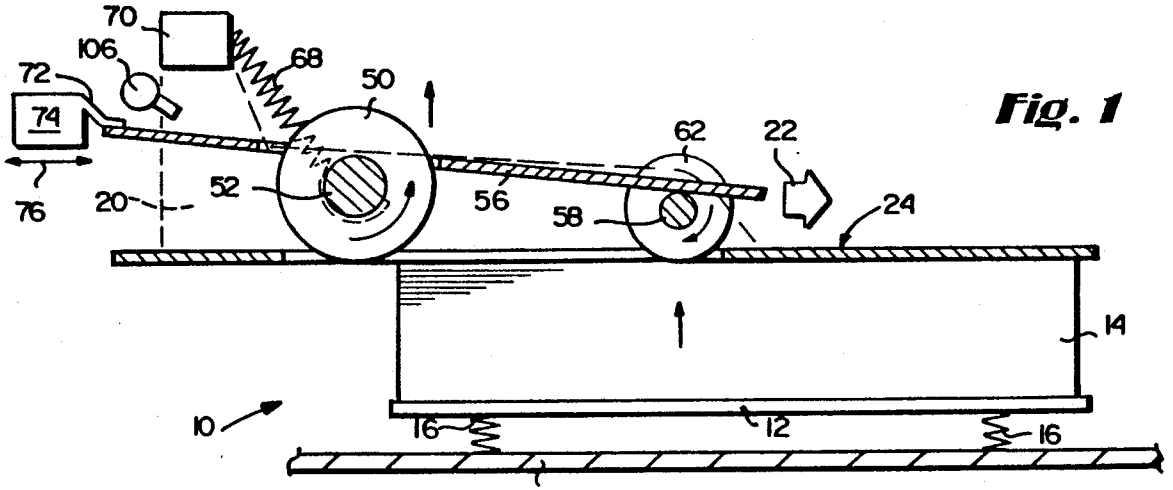
FIG. 1 is a partial side view, partly in section and partly in schematic form, of a sheet separating mechanism of a device in accordance with the invention.
Figure 2:
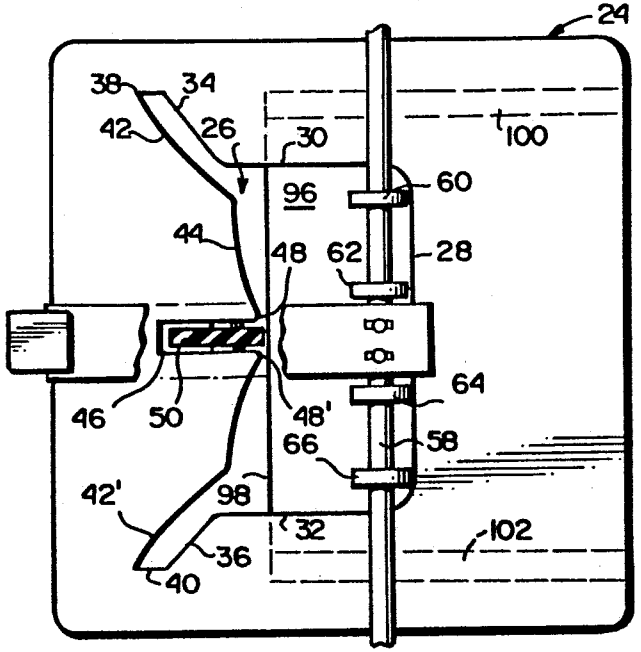
FIG. 2 is a plan view of a separator mechanism and pick wheel device incorporated in the apparatus of FIG. 1.
Figure 3:
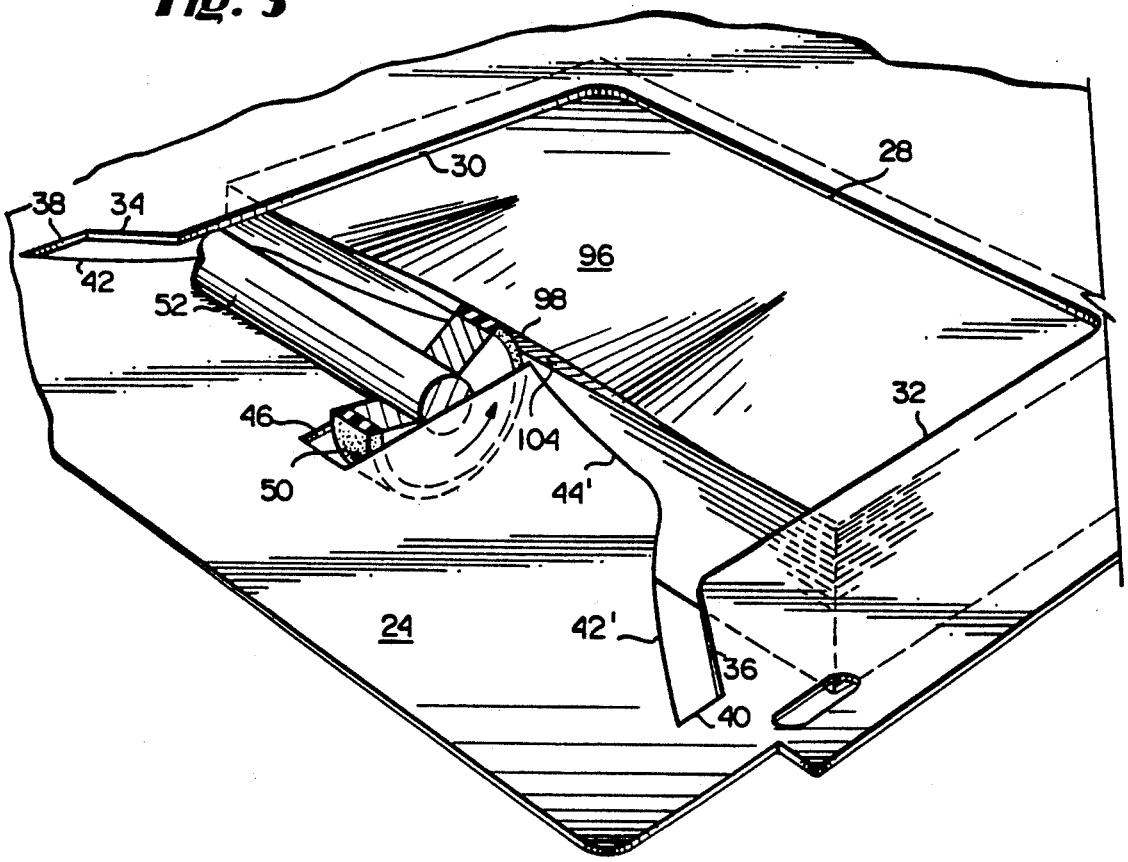
FIG. 3 is a partial perspective view of the sheet separating device in accordance with this invention.

With reference now to FIGS. 1-3, the apparatus 10 of this invention includes a support plate 12 which supports an adhesive pad or stack 14 of adhesive label sheets. The stack or pad is biased upwardly by any suitable means, such as one or more coil springs 16 mounted between the bottom wall 18 of an enclosure or housing and the underside of the plate 12.

The separator mechanism includes a frame 20 movable horizontally to the right as viewed in FIG. 1 (and as indicated by the arrow 22) relative to the stack 14. The frame 20 is fixed by any suitable means) to a planar separator blade 24 which has a generally square or rectangular shape (as determined by the size and shape of the label sheets). The blade 24 is formed of relatively thin metal sheet, and has an irregularly (but symmetrical) opening 26 stamped therein, through which the uppermost label sheet will pass as the blade 24 moves under the latter, as described below.

The opening 26 includes a straight, transverse (to the direction of movement of the blade) edge 28 which connects to straight, rearwardly extending edges 30, 32 which, in turn, flare outwardly and rearwardly at 34, 36, respectively. Edges 34, 36 terminate at a pair of short, rearwardly extending edges 38, 40, respectively which are substantially parallel to edges 30, 32. These edges 38, 40 are laterally spaced a distance slightly greater than the transverse dimension of the label sheets, and serve to guide and hold the uppermost sheet as the blade moves through the stack, as also described below. The edges 38, 40 are connected at the rearward end of opening 26 by a pair of double arc curves 42, 44 and 42', 44' which are joined at the center of the blade by an elongated, rearwardly extending slot 46. At the interface of slot 46 and curves 44 and 44', there are formed a pair of entry projections 48, 48' which are the first blade elements to be inserted between the uppermost label sheet and the remainder of the stack.

A rubber pick wheel 50 is located in the slot 46, and is mounted for rotation on a shaft 52 which, in turn, is supported at opposite sides of the frame 20. With brief reference to FIG. 10, it should be noted that the shaft 52 is mounted in vertically extending slots 54 (one shown) formed in the sides of frame 20, thus permitting upward movement of the pick wheel 50 as explained below.

The shaft 52 of the pick wheel 50 is also secured to a trip lever 56 which, at its forward end, is secured for pivotal movement relative to a shaft 58 supported at opposite ends in the frame 20. The shaft 58 also supports two pair of rollers 60, 62 and 64, 66, one pair on each side of the lever 56 as best seen in FIG. 2. Rollers 60, 62, 64 and 66 facilitate movement of the separator mechanism including frame 20 across the stack 14 by rolling over the uppermost sheet of the stack during forward and rearward movement of the frame 20. The lever 56 is also biased in an upward direction by a pair of springs (one shown at 68) adjacent the respective frame sides, and connected between a handle portion 70 of the frame and the shaft 52. In a set position, prior to an operative forward stroke of the separator mechanism, the lever 56 and pick wheel 50 are held in the position shown in FIG. 1 by a trip release arm 72 fixed to the housing. In order to insure a precise release point for the lever 56, the arm 72 and its support 74 are adjustable in forward and rearward directions, as indicated by arrow 76.

Turning briefly to FIGS. 9 and 10, the frame 20 is supported at its rearward end by an axle or main drive shaft 78 and a pair of geared drive wheels 80, 82 secured at the ends of the shaft 78. Drive wheels 80, 82 engage laterally spaced, fixed gear tracks 84, 86 which extend in the direction of travel of the separator mechanism. The pick wheel shaft 52 is drivingly connected to the main drive shaft 78 through a gear train including gears 88, 90, 92 and 94 which establishes a desired relative speed as between the drive wheels 80, 82 and pick wheel 50, and which also establishes a counterclockwise rotation for the pick wheel 50 upon forward, clockwise rotation of the drive wheels 80, 82.

Figure 4:
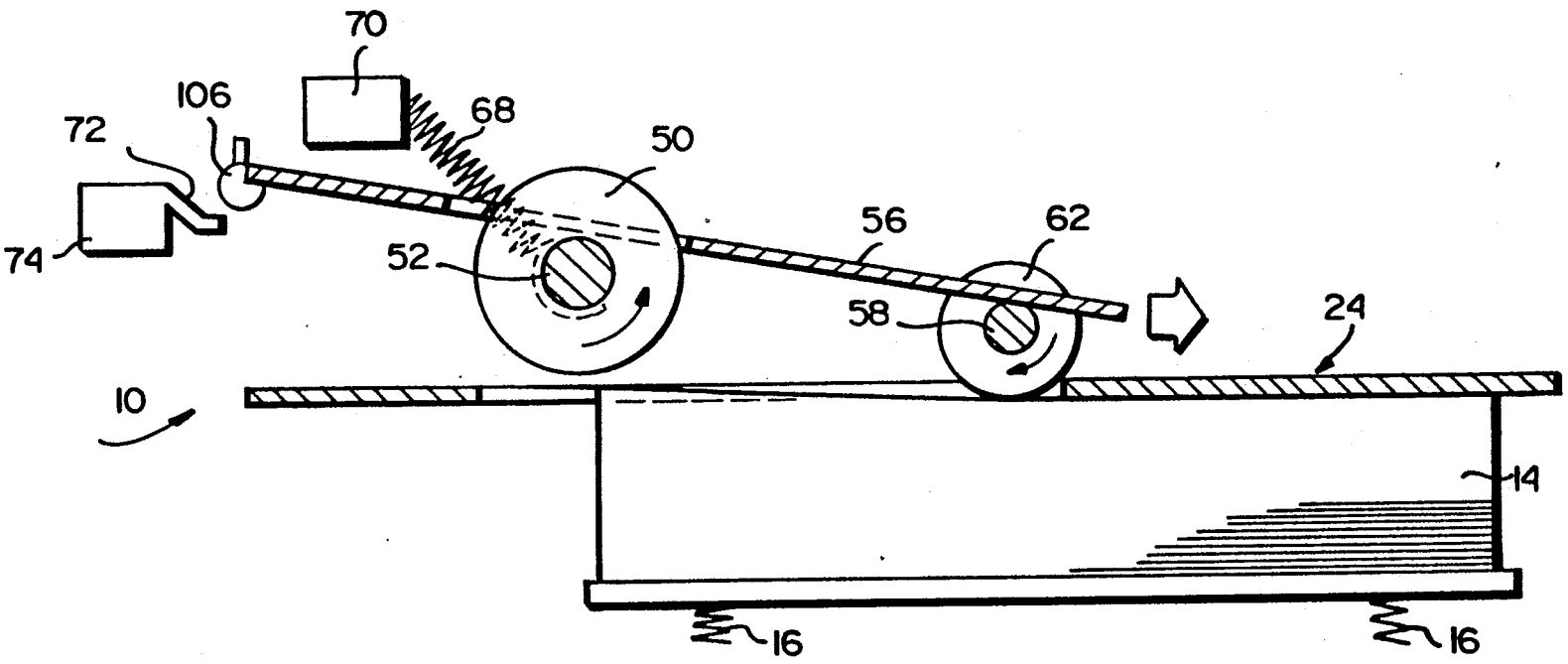
FIG. 4 is similar to FIG. 1 but illustrates the separating mechanism upon initial insertion of the separator blade between the uppermost sheet and the remaining sheets of the stack or pad.

The operation of the device will now be described with particular reference to FIGS. 1, 3, 4 and the sequence of blade/label sheet relative positions shown in FIGS. 5 through 8.

To set the device for an initial separation of an uppermost sheet 96 in the stack or pad 14, the frame 20 is moved to the left, to the position shown in FIG. 1, with the blade 24 overlying the sheet 96 as best seen in FIG. 2. Note that in this position, the pick wheel 50 is spaced slightly to the left of the sheet edge 98, but slightly ahead of the blade entry projections 48, 48'.

The operator, grasping the handle portion 70 of the frame 20, then moves the frame 20 to the right, as indicated by arrow 22. The pick wheel 50 rotating in a counterclockwise direction, will first engage the edge 98 of the uppermost label sheet 96 and will lift the edge, centrally of the sheet, keeping in mind that the adhesive strips 100, 102 extend along the opposite edges which extend parallel to the direction of movement of the frame. This initial lifting of the central portion of edge 98 is best seen in FIG. 3. Immediately upon lifting of the edge 98, projections 48 and 48' enter the space between the uppermost sheet 96 and the next adjacent sheet 104. Simultaneously, the rear edge of lever 56 moves beyond the appropriately adjusted trip release arm 72, so that springs 68 will lift shaft 62 and pick wheel 50 upwardly (about the shaft 58) to the position shown in FIG. 4. This action will also disconnect gear 94 from gear 92 as the shaft 52 moves upwardly in the slot 54. The pick wheel 50 is now, in essence, an idler roll, and is positioned so as not to interfere with the separation of the sheet 96 by the blade 24 as the frame 20 continues to move forward.

Figure 7:
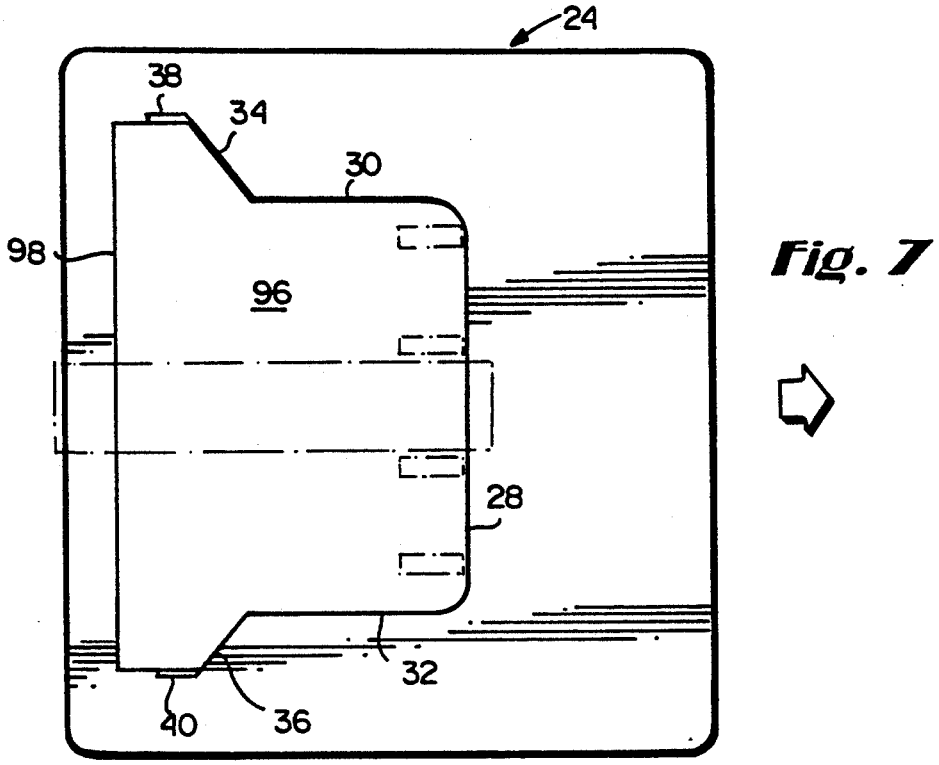
Figure 8:
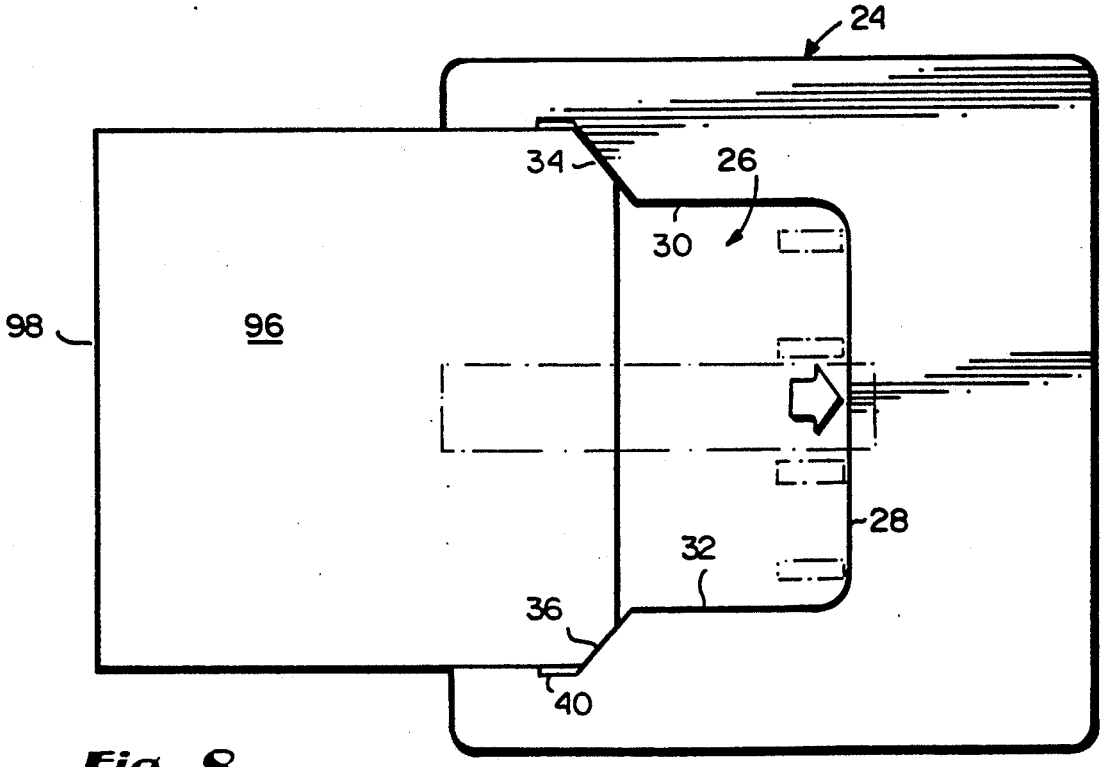

As frame 20 continues its forward or separating stroke, the uppermost sheet 96 will move through the opening 26 in the blade 24, with progressive outward separation along the edge 98 effected by the curved edges 44, 44' and then 42, 42' of the blade opening. Separation at the location of adhesive strips 100, 102 occurs initially as the outwardmost portions of edges 42, 42' separate the outermost portions of edge 98 as depicted in FIGS. 6 and 7. From this point, the adhesive strips 100, 102 continue to be separated as the frame 20 moves through the final portion of its forward stroke as shown in FIG. 8. During the entire forward stroke of frame 20 and associated blade 24, the uppermost sheet 96 does not move horizontally relative to the stack or pad 14. It is merely separated therefrom so that upon completion of the stroke, the now separated sheet 96 may be lifted off the stack in a substantially flat condition, without curled edges.

The frame 20 is then retracted to the left, to its initial, FIG. 1 position, and the lever 56 is pushed downwardly so that its rearward edge can be secured under the trip/-release arm 72, and so that the gear 94 is re-engaged with gear 92. The device is now ready for the separation of the next label sheet 104 from the stack 14 (which has been raised the minute but necessary distance by springs 16).

With reference again to FIG. 1, it will be appreciated that the re-setting of lever 56 may be effected automatically by, for example, a pivotally mounted re-set bar 106. The bar 106 may be activated electrically or mechanically to press the lever 56 downwardly and to release the latter once under the trip/release bar 72.

It will also be appreciated that other modifications may be made to the above described apparatus and nevertheless remain within the scope of the invention. For example, an ejection wheel may be provided to move the separated sheet horizontally away from the stack. In addition, the various mechanical elements as described may be combined with or replaced by suitable electronic means to achieve the same result.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. For use with a pad of sheets where each sheet is adhered to an underlying sheet by a pair of laterally spaced, substantially parallel strips of light tack adhesive located along opposite side edges of the sheet, a device for separating an uppermost sheet of said pad comprising:

lifting means for lifting a transverse edge of the uppermost sheet intermediate said parallel strips of light tack adhesive;

blade means for insertion between said uppermost sheet and an underlying sheet at a location where said transverse edge has been lifted by said lifting means; and drive means for moving said blade means in a first direction parallel to said strips of light tack adhesive through the pad to thereby separate the uppermost sheet from the underlying sheet.

2. The device of claim 1 wherein said lifting means comprises a pick wheel.

3. The device of claim 1 wherein said blade means comprises a relatively thin plate having front and rear edges and a closed periphery opening formed therein between said front and rear edges.

4. The device of claim 3 wherein said closed periphery opening includes a partially rectangular portion for receiving said lifting means.

5. The device of claim 4 wherein said partially rectangular portion terminates at a pair of plate projections which are adapted for first insertion between said uppermost sheet and said underlying sheet at said transverse edge upon actuation of said drive means and wherein said uppermost sheet passes through said opening during movement of said blade means.

6. The device of claim 5 wherein said plate projections are located substantially midway along said edge.

7. The device of claim 1 and further including a platform supporting the pad, said platform resiliently biased in an upward direction.

8. The device of claim 2 wherein said drive means includes a pair of drive wheels and a gear train interposed between said drive wheels and said pick wheel, said drive train arranged to cause said pick wheel to rotate in a direction opposite that of said drive wheels.

9. The device of claim 1 wherein said lifting means is movable between a first operative position and a second non-operative position.

10. A sheet separating device for removing an uppermost sheet of an adhesive pad containing a plurality of such sheets, the device comprising:

a housing;

a support plate for holding said pad, said support plate being resiliently biased in an upward direction;

a sheet separator mechanism movable in forward and rearward directions, said sheet separator mechanism including a frame, a pick wheel mounted for rotation within said frame, and a knife blade having a closed periphery opening therein defined in part by at least one entry projection, wherein said pick wheel is located ahead of said at least one entry projecting of said knife blade in said forward direction such that, in use, said pick wheel lifts an edge of said uppermost sheet extending transverse to said forward direction, and said at least one entry projection of said knife blade then moves between between said uppermost sheet and a next underlying sheet as said uppermost sheet passes through said closed periphery opening.

11. The device of claim 10 wherein said pick wheel is mounted on a first shaft which is fixed to an elongated lever pivotally mounted at one end for movement between operative position to engage the uppermost sheet, and an inoperative position when the pick wheel is positioned above said uppermost sheet.

12. The device of claim 11 wherein said lever is biased toward said inoperative position.

13. The device of claim 11 wherein a trip release arm is engageable with an opposite end of said lever to hold said pick wheel in said operative position until said pick wheel lifts said edge of said sheet, and disengageable with said opposite end of said lever to allow said pick wheel to move to said inoperative position.

14. The device of claim 13 wherein said trip release arm is mounted for horizontal adjustment in said forward and rearward directions.

15. The device of claim 11 and including guide wheels located ahead of said pick wheel in said forward direction, said guide wheels mounted on a second shaft, said lever pivotally mounted at said one end to said second shaft.

* * * * *